United States Patent [19]

Herzstein

[11] 4,008,836

[45] Feb. 22, 1977

[54] YARN THREADER AND METHOD OF THREADING A NEEDLE

[76] Inventor: Gwendolyn Marie Herzstein, 219 Vidal Drive, San Francisco, Calif. 94132

[22] Filed: Jan. 15, 1976

[21] Appl. No.: 649,296

[52] U.S. Cl. ..... 223/99

[51] Int. Cl.[2] ..... D05B 87/02

[58] Field of Search ..... 223/99, 101

[56] References Cited

UNITED STATES PATENTS

| | | | |
|---|---|---|---|
| 424,518 | 4/1890 | Norman | 223/99 |
| 1,026,479 | 5/1912 | Turner | 2/200 X |
| 1,070,927 | 8/1913 | Sonnenfeld | 223/99 |
| 3,006,518 | 10/1961 | Lillard | 223/99 |
| 3,838,801 | 10/1974 | David | 223/99 |

*Primary Examiner*—George H. Krizmanich
*Attorney, Agent, or Firm*—Townsend and Townsend

[57] ABSTRACT

A yarn threader comprising a flat, stiff foldable member for enfolding the end of yarn, the member forming a projecting point which will enter a needle eye sufficiently while enfolding the yarn end so that the yarn end may be grasped on the opposite side of the needle eye.

5 Claims, 6 Drawing Figures

YARN THREADER AND METHOD OF THREADING A NEEDLE

BACKGROUND OF THE INVENTION

Most people have difficulty in threading multiple yarns in needles even in those needles having large eyes and designed for such yarns. Various devices have been offered to make the job of threading yarn needles more convenient although none of these devices has been entirely successful. Such devices have included wire loops which are inserted through the needle eye and which then pull a loop of the yarn through the needle eye, or narrow, flat devices having a hole or holes therein through which the yarn is inserted, the device then being pulled or pushed through the needle eye. Still another device utilizes a projection having a hole upon which the needle eye is placed, the yarn threaded through the projection and then the needle removed therefrom so that a loop of yarn is pulled through the needle eye. Still another offering is the method of threading a needle shown in U.S. Pat. No. 3,482,539 involving essentially the forming of a point using absorbent cotton so that the point can be inserted through the needle eye. Devices such as were described above include those in U.S. Pat. Nos. 3,838,801 and 3,840,160 as well as older related devices shown in U. S. Pat. Nos. 2,167,080 and 3,006,518. None of the prior art devices or methods shown approaches the present invention in simplicity or in ease of operation.

SUMMARY OF THE INVENTION

The yarn threader of the present invention comprises a flat, stiff member foldable along an axis thereof. The threader may be made of stiff paper, plastic, spring steel or any other such product, the member being thin enough to permit the doubled thickness thereof to be inserted in the eye of a needle when the end of the yarn to be threaded is enfolded within the member. The member, when folded, forms a projecting point which will enter a needle eye sufficiently while enfolding the yarn end so that the yarn end may be grasped and the member removed from the needle eye thus leaving the needle threaded. Since the yarn threader is foldable and then folded in use, there is no need for users to thread the yarn end through any hole at all as in prior art devices nor is a steady hand or a sharp eye required to accomplish the desired result.

The yarn threader may be of various shapes so that when it is folded and the yarn end placed in the crease, there will be at least one projecting point carrying the yarn end. The projecting point may be a 90° or even smaller angle depending upon the thickness of the yarn and the size of the needle eye. The angle of the point will also depend to some extent upon the material from which the threader is made, but the scope of the invention encompasses many variations to accommodate the myriad forms of yarn and needles available.

DESCRIPTION OF THE PREFERRED EMBODIMENT

Figure 1:
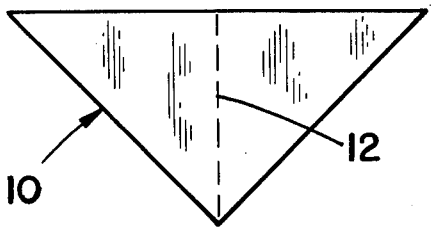
FIG. 1 is a view illustrating the yarn threader and the axis for folding.
Figure 2:
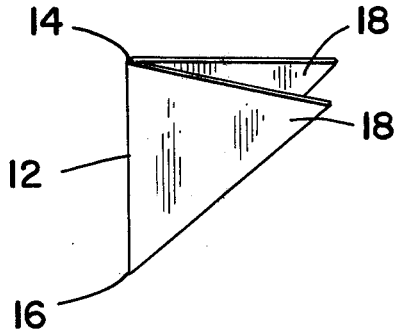
FIG. 2 shows the threader as folded and prior to the insertion of the yarn end.
Figure 3:
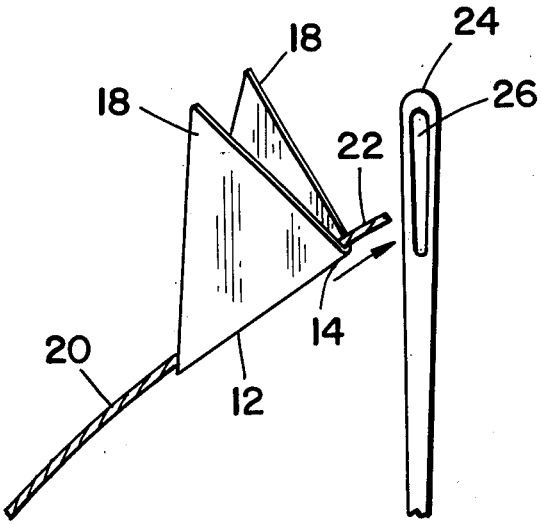
FIG. 3 shows the threader with the yarn end enfolded within it and about to be inserted into the needle eye.

Referring now more particularly to the drawings in which the same numerals refer to the same parts in each of the several views an embodiment of the yarn threader is shown in FIG. 1. The yarn threader comprises a triangular shaped member 10 foldable along a fold line or axis 12. When the yarn threader is folded along axis 12 it forms a device as shown in FIG. 2 having two ends forming projecting points 14 and 16 and a pair of wings 18.

Figure 4:
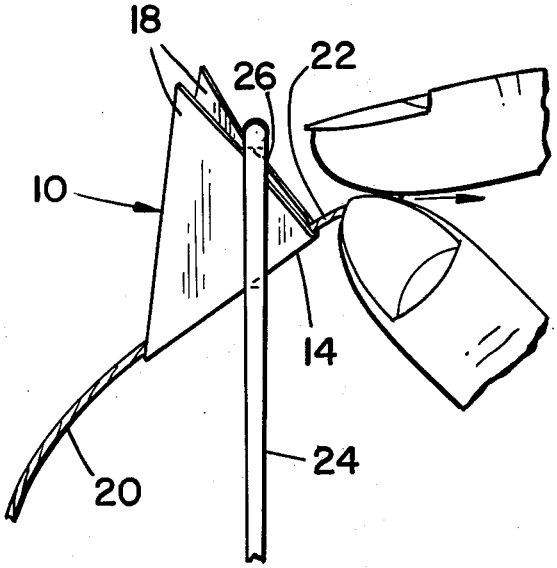
FIG. 4 shows the yarn threader projecting point inserted in the needle eye with the yarn end about to be grasped on the opposite side of the needle.
Figure 5:
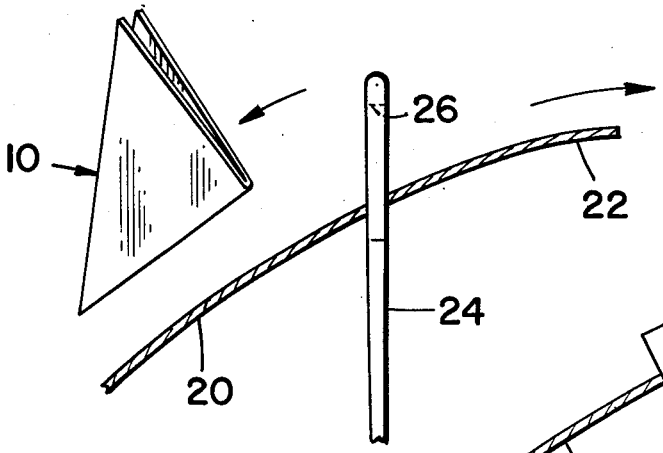
FIG. 5 shows the threaded needle with the threader being removed from the needle eye.

The threader is used by placing the yarn inside the wings 18 and against the inside of the fold line 12 with the end 22 of the yarn 20 projecting slightly past the projecting point 14. The wings 18 are squeezed and the projecting point 14 with the slightly projecting yarn end 22 is brought adjacent a yarn needle 24 having a large eye 26. The projecting point and yarn end are placed into the needle eye 26 and pushed through as far as the projecting point 14 will go. As may be seen more clearly in FIG. 4, projecting point 14 with yarn end 22 is through the needle eye 26 with the balance of the yarn 20 trailing behind the yarn threader and the needle. The user grasps yarn end 22 and simply withdraws the yarn threader 10 leaving yarn end 22 through the needle and thus the user is able to pull more of the yarn through the needle eye.

Figure 6:
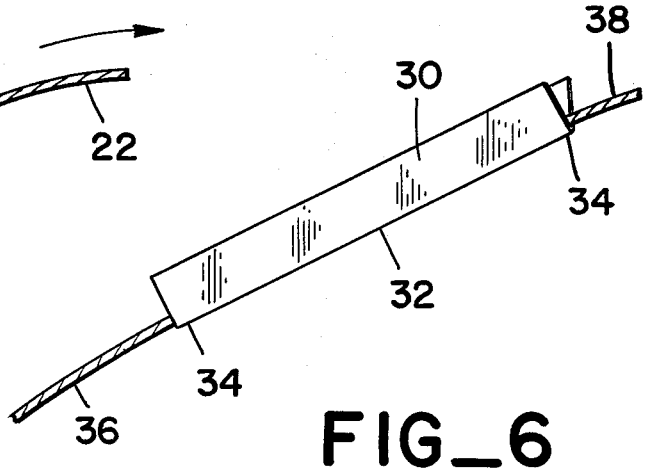
FIG. 6 illustrates another embodiment of the yarn threader invention.

As an alternative, the projecting point 16 of the yarn threader which has a smaller angle then point 14 may be used in the event the needle eye 26 is smaller. An alternative embodiment of the yarn threader invention is shown in FIG. 6. This yarn threader comprises an elongate foldable member 30 in which the fold line 32 is along the longitudinal axis of the yarn threader member 30. When the member is folded there are two ends 34 forming projecting points, either of which may be used for purposes of threading yarn in needles. As can be seen in FIG. 6, the yarn 36 is placed within the elongate member with the yarn end 38 projecting slightly beyond the point. This embodiment may be utilized in the same manner as that previously described. In some instances the elongate embodiment as shown in FIG. 6 may be preferred since it can be larger and thus more easily handled by those persons who are unable to accommodate the small size of the embodiment previously described.

The method of threading a needle comprises the steps of folding a flat, stiff member 10 or 32 such as that shown in FIG. 1 or FIG. 6, placing yarn 20 or 36 inside the member and against the crease or fold line 12 or 32 with the respective ends 22 or 38 extending slightly past the projecting points 14 or 34. The projecting point 14 or 34 is inserted into one side of the needle eye, the yarn end 22 or 38 is grasped on the opposite side of the needle eye and the projecting point and member removed from the needle eye and yarn thus leaving the needle threaded and ready for use.

Either of the two embodiments disclosed above are capable of quickly and easily threading various sizes and thicknesses of yarns in varying sizes of needles. As is no doubt clear, the yarn threader is easily manufactured at low cost and may be suitable for use as a gift or premium by yarn manufacturers.

The embodiments described are illustrative only of the principles of the invention. Other modifications will occur to those skilled in the art without departing from the spirit or scope of the claims.

I claim:

1. A yarn threader comprising a flat, stiff foldable generally planar member having a thickness sufficiently thin to permit its doubled thickness together with a thickness of yarn to be inserted in the eye of a needle when the end of the yarn is enfolded within the member, the member being folded along a crease, the folded member having transverse dimensions large relative to a needle eye, the folded member forming a projecting point at an end of said crease which will enter a needle eye sufficiently while enfolding the yarn end disposed within the folded member proximate the crease so that the yarn end may be grasped and the member removed from the eye thus leaving the needle threaded.

2. The yarn threader of claim 1 wherein the member is in the shape of a triangle and foldable on a line perpendicular to the base thereof and through the opposite the apex to form projecting points at either end of the folded member.

3. The yarn threader of claim 1 wherein the member is rectangular in shape and foldable along an elongate axis to form a pair of projecting points at opposite ends of the member.

4. The yarn threader of claim 1 wherein the member is made of stiff paper.

5. A method of threading a needle comprising the steps of:

folding a flat, stiff generally planar member to form a folded member having transverse dimensions large relative to the eye of said needle and at least one projecting point, placing yarn inside the member and against the crease with the yarn end projecting slightly at the projecting point, inserting the projecting point carrying the yarn end into one side of a needle eye grasping the yarn end on the opposite side of the needle eye, and removing the member's projecting point from the needle eye and the member from the yarn leaving the needle threaded.

* * * * *